United States Patent [19]

Knepper et al.

[11] 4,120,355

[45] Oct. 17, 1978

[54] METHOD FOR PROVIDING FLUID COMMUNICATION FOR IN SITU SHALE RETORT

[75] Inventors: Jay C. Knepper, Denver; Eugene L. Grossman, Littleton, both of Colo.

[73] Assignee: Standard Oil Company (Indiana), Chicago, Ill.

[21] Appl. No.: 829,070

[22] Filed: Aug. 30, 1977

[51] Int. Cl.[2] ..... E21C 41/10; E21B 43/24; E21B 33/13

[52] U.S. Cl. ..... 166/259; 166/50; 166/293; 299/2; 299/11; 299/19

[58] Field of Search ..... 299/2-5, 299/11, 19, 13; 166/50, 259, 256, 271, 260, 261, 247, 293; 208/11 R

[56] References Cited

U.S. PATENT DOCUMENTS

| | | | |
|---|---|---|---|
| 1,004,419 | 9/1911 | Griffith | 299/11 |
| 2,906,337 | 9/1959 | Hennig | 166/259 X |
| 3,233,668 | 2/1966 | Hamilton et al. | 166/259 |
| 3,342,257 | 9/1967 | Jacobs et al. | 166/259 UX |
| 3,406,620 | 8/1969 | Parker | 166/247 UX |
| 3,459,003 | 8/1969 | O'Neal | 61/35 |
| 3,490,529 | 1/1970 | Parker | 166/247 X |
| 3,502,372 | 3/1970 | Prats | 166/247 X |
| 3,588,175 | 6/1971 | Whiting | 299/11 |
| 3,597,347 | 8/1971 | Ellington, Jr. | 208/11 R |
| 3,661,423 | 5/1972 | Garrett | 299/2 |
| 3,950,029 | 4/1976 | Timmins | 166/256 X |

*Primary Examiner*—Stephen J. Novosad
*Attorney, Agent, or Firm*—Frank J. Sroka; Arthur G. Gilkes; William T. McClain

[57] ABSTRACT

Disclosed is a method for providing communication with a subterranean oil shale retort. This method can be used to provide a means of introducing fluids, such as a slurry of spent oil shale in water, into a retort. The method for providing lateral communication with a subterranean oil shale retort containing a rubblized retortable mass of oil shale, said retort being substantially surrounded by a mass of unmined formation comprises drilling at least one hole through the unmined formation adjacent to the retort; and providing communication between at least one of said holes and an adjacent retort; so that said drill hole can be used to communicate fluids to said retort. Fluids can be introduced into a spent retort which will form a supporting structure within said retort.

5 Claims, 1 Drawing Figure

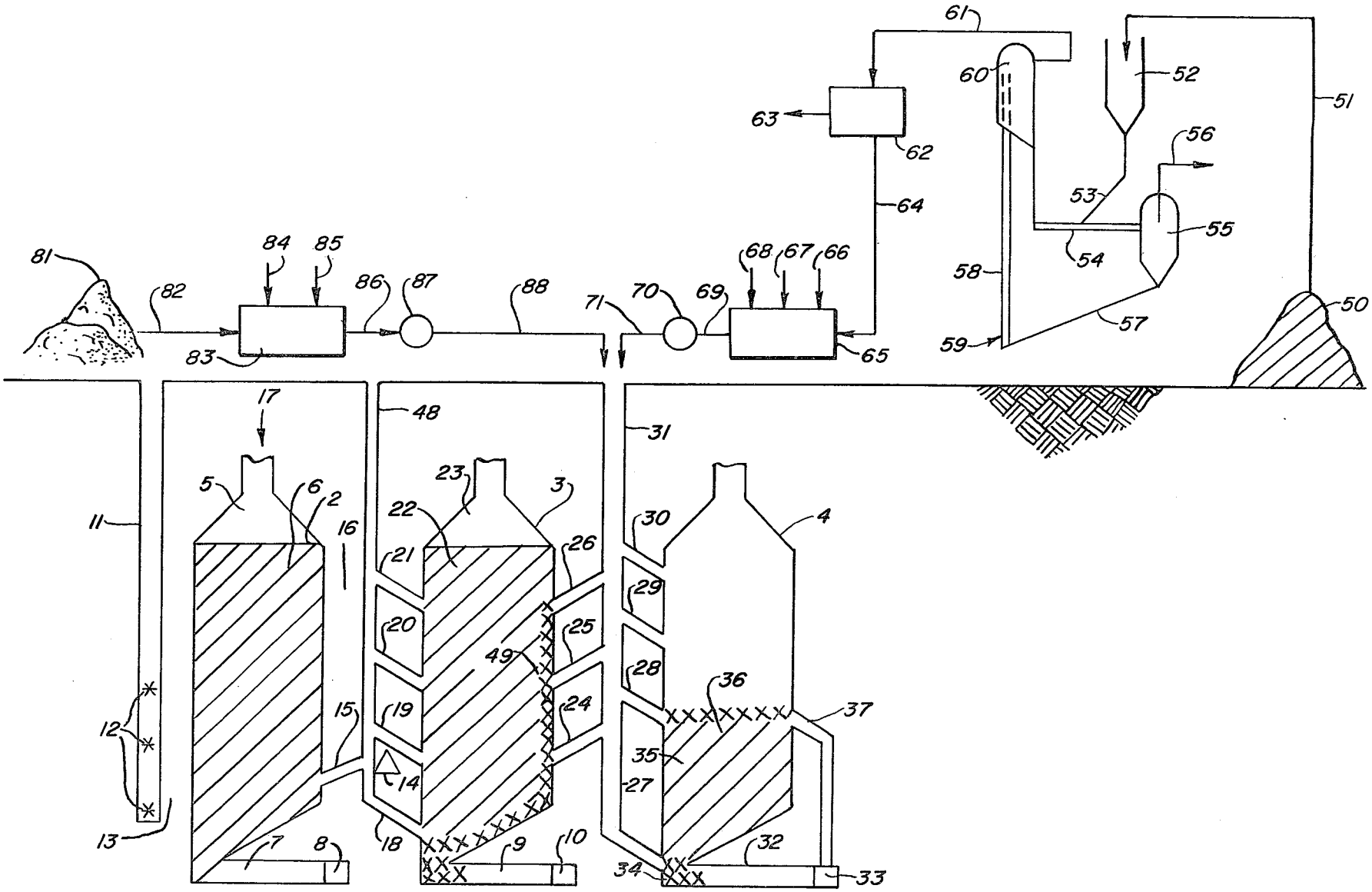
51
50
52
56
55
57
53
54
61
60
58
59
62
64
63
65
66
67
68
69
70
71
88
87
86
85
84
83
82
81
4
37
33
32
36
35
31
30
29
28
27
34
3
26
25
24
10
9
49
23
22
21
20
19
14
18
48
16
15
8
2
6
17
5
7
11
12
13

METHOD FOR PROVIDING FLUID COMMUNICATION FOR IN SITU SHALE RETORT

BACKGROUND

This invention relates to subterranean oil shale in situ retorting and methods for providing communication with underground retorts. The invention also relates to a method of introducing fluids into an underground retort.

The term oil shale refers to sedimentary deposits containing organic materials which can be converted to oil shale. Oil shale contains an organic material called kerogen which is a solid carbonaceous material from which shale oil can be retorted. Upon heating oil shale to a sufficient temperature, kerogen is decomposed and a liquid product is formed.

Oil shale can be found in various places throughout the world, especially in the United States in Colorado, Utah and Wyoming. Some especially important deposits can be found in the Green River formation in Piceance Basin, Garfield and Rio Blanco counties, and northwestern Colorado. Oil shale can be retorted to form a hydrocarbon liquid either by in situ or surface retorting. In surface retorting, oil shale is mined from the ground, brought to the surface, and placed in vessels where it is contacted with hot retorting gases. The hot retorting gases cause shale oil to be freed from the rock. Spent retorted oil shale which has been depleted in kerogen is removed from the reactor and discarded. Some well known methods of surface retorting are the Tosco, Lurgi, and Paraho processes.

In the Tosco process ceramic balls heated by combustion of retort off-gas, contact shale in a horizontal rotary kiln. Kerogen is broken down and emanates from the kiln as gases which are fractionated to yield liquid products plus off-gas which is in turn combusted to heat the ceramic balls. Spent shale is separated from the ceramic balls by screening, cooled and sent to disposal. The ceramic balls are recycled to a heater.

In the Lurgi process carbon on spent shale is combusted in a riser heater. The hot spent shale is separated from combustion products and mixed with fresh shale feed in a sealed screw conveyor. Gases from this contact are fractionated to yield liquid products and combustible off-gas for use.

In the Paraho process fresh shale is fed to the top of a vertical shaft kiln, contacted with hot gases produced by either in situ combustion of coke on spent shale or externally heated recycle gas. Kerogen breakdown products are withdrawn from the kiln by vapor-collecting tubes near the top of the kiln. Spent shale is removed from the bottom of the kiln by a grate system. Vapors leaving the kiln are separated to yield oil product and combustible gas for use.

Another method of retorting oil shale is the in situ process. In situ retorting of oil shale generally comprises forming a retort or retorting area underground, preferably within the oil shale zone. The retorting zone is formed by mining an access tunnel to or near the retorting zone and then removing a portion of the oil shale deposit by conventional mining techniques. About 5 to about 40 percent, preferably about 15 to about 25 percent, of the oil shale in the retorting area is removed to provide void space in the retorting area. The oil shale in the retorting area is then rubblized by well-known mining techniques to provide a retort containing rubblized shale for retorting.

A common method for forming the underground retort is to undercut the deposit to be retorted and remove a portion of the deposit to provide void space. Explosives are then placed in the overlying or surrounding oil shale. These explosives are used to rubblize the shale, preferably forming an area of rubble having uniform particle size. Some of the techniques used for forming the undercut area and the rubblized area are room and pillar mining, sublevel caving, and the like. After the underground retort is formed, the pile of rubblized shale is subjected to retorting. Hot retorting gases are passed through the rubblized shale to effectively form and remove liquid hydrocarbon from the oil shale. This is commonly done by passing a retorting gas such as air or air mixed with steam and/or hydrocarbons through the deposit. Most commonly, air is pumped into one end of the retort and a fire or flame front initiated. This flame front is then passed slowly through the rubblized deposit to effect the retorting. Not only is shale oil effectively produced, but also a mixture of off gases from the retorting is also formed. These gases contain hydrogen, carbon monoxide, ammonia, carbon dioxide, hydrogen sulfide, carbonyl sulfide, oxides of sulfur and nitrogen, and low molecular weight hydrocarbons. Generally a mixture of off gases, water and shale oil are recovered from the retort. This mixture undergoes preliminary separation commonly by gravity to separate the gases from the liquid oil from the liquid water. The off-gases commonly also contain entrained dust and hydrocarbons, some of which are liquid or liquefiable under moderate pressure. The off-gases commonly have a very low heat content, generally less than about 100 to about 150 BTU per cubic foot.

Because underground retorts are generally quite large in size and large quantities of air or oxygen containing gases are needed to support combustion, large amounts of off gases are formed during retorting. Because these off gases contain both impurities and also recoverable energy, it is highly desirable to find an effective method of treating these gases and also recovering energy in useable form. It is also quite important that these off gases are treated in such manner as to be compatible with the environment.

A number of patents describe methods of in situ retorting of oil shale. Karrick, L.C., U.S. Pat. No. 1,913,395, is directed to the in situ gasification of underground carbonaceous materials, such as oil shale. After an excess tunnel from the surface is formed, about 10 to 40 percent of the gasification zone is mined out in order to provide voids in the deposits and to provide various tunnels. Long drill holes are made in the roof, walls and floor of certain tunnels to be filled with explosives which will form a rubble suitable for burning or gasification. The proper spacing of the blast holes including their depth, size of powder charge and order of firing are considered important. It is thought that this technique will break the deposit sufficiently to form loose pervious masses of uniform permeability. It is preferred to use a steeply sloping or vertical combustion chamber when working deposits such as oil shale from Colorado. Downflow of oxygen as a combustion gas is shown.

Karrick, S.N., U.S. Pat. No. 1,919,636, teaches the in situ recovery of oil shale in large vertical chambers or tunnels which are substantially full of broken shale. Hot retorting gases are passed either downwardly or upwardly through the chambers. The vertical retorting areas can be formed by mining small sloping branch raises or slots. The walls of these raises are drilled and blasted from bottom to top, filling the chamber with broken material. Oil shale is removed to provide a porosity of 25 to 40 percent. Retorting is conducted with downflow of retorting gases such as air and combustible gas. Another technique for rubblizing oil shale is described in conjunction with FIG. 10. A number of development tunnels are drilled at the base of the oil shale deposit to provide a work area and void space. Next holes are drilled into the roof of the tunnel, filled with explosives and detonated to break the roof in large blocks averaging 2–3 feet in minimum diameter. Another round of holes are drilled and fired, each round bringing the pile of broken shale nearer to the roof. In this case the retort is horizontal. Retorted shale oil collects initially at the bottom of the retort.

Uren, U.S. Pat. No. 2,481,051, is directed to a method of in situ distillation of carbonaceous materials such as oil shale. An access tunnel down into the deposit is mined from which mine drifts and raises are driven under, over and through the deposit selected for treatment. The mined oil shale is removed. Commonly, the mind drifts are separated vertically by about 150 feet of oil shale. Various methods of stoping may be employed such as shrinkage stoping or block caving. Shrinkage stoping is recommended. In this method the rock is excavated progressively upward from one level to the next, the miners drilling and blasting away the overhead "back". The miners stand and set up their equipment upon the rock previously broken, just enough of the broken material being drawn through chutes into drifts below to leave suitable head room between the back and the top of the broken rock. In this method of stoping, approximately one-third of the rock may be withdrawn and two-thirds remains in the stope. Retort combustion is generally conducted in a downward direction by the initial injection of air and combustible fuel or gas and subsequently by either air injection alone or in conjunction with fuel. Shale oil is recovered at the bottom of the retort.

Van Poollen, U.S. Pat. No. 3,001,776, is directed to the in situ retorting of oil shale and teaches that the retorts can be formed by well-known mining practices which may include sublevel stoping, shrinkage stopes, sublevel caving or block caving. An access shaft is mined with various drifts so that the retorting area can be worked at a plurality of levels. The overlaying oil shale above a stope is fractured, generally by explosives detonated in blast holes in the overhead deposit. Some of the oil shale is removed to achieve the desired porosity. The retort filled with rubble can be retorted in either the upflow or downflow direction by the injection of air. Ignition can be accomplished by any suitable method such as oxygen used in conjunction with natural gas.

Ellington, U.S. Pat. No. 3,586,377, is directed to a method of in situ recovery of shale oil. The method of obtaining shale oil from a zone of unmined oil shale comprises establishing access means at least two points in said zone, establishing communication between these access means through the zone, fragmenting at least part of the oil shale in the zone in the area of the communication to produce a porous mass of fragmented oil shale, supplying heating means to said fragmented oil shale through one of said access points to pyrolyze shale oil in the oil shale and collecting said shale oil through the other of said access means.

Prats, U.S. Pat. No. 3,434,757, is directed to a method of in situ recovery of shale oil wherein the rubblized oil shale is created by forming at least two tunnels, exploding the archways between the tunnels and thereby creating a large roof which collapses. Another series of explosives extending radially upward and substantially parallel to the tunnels is detonated to rubblize the overlaying oil shale. Hot fluid is then circulated through the permeable mass of oil shale to release the shale oil.

Garrett, U.S. Pat. No. 3,661,423, is directed to the recovery of carbonaceous values by in situ retorting of rubblized deposits such as oil shale. A limited undercut is made over a large area leaving an overlaying deposit supported by a multiplicity of pillars. The pillars are then removed and the overlaying deposit expanded to fill the void with particles of uniform size, porosity and permeability. Communication is then established with the upper level of the expanded deposit and a high temperature gaseous media which will liquefy or vaporize the carbonaceous values is introduced in a manner which causes the released values to flow downward for collection at the base of the expanded deposit. Convenient media are hot flue gases created by igniting the upper level of the expanded carbonaceous deposit forcing a flow of hot gases downward through the expanded deposit.

Ridley, U.S. Pat. No. 3,951,456, discloses an in situ process for recovering carbonaceous values from a subterranean deposit comprising the steps of (a) developing an in situ rubble pile within a retorting chamber of a subterranean carbonaceous deposit having a retorting fluid entrance and retorting fluid exit, said rubble pile being formed by undercutting at about the base of the carbonaceous deposit to remove a predetermined volume of material and form a sloped floor having a high point at the shortest retorting fluid path between the retorting fluid entrance and the floor and the low point at the periphery of the floor and expanding the deposit to form the in situ rubble pile wherein the bulk permeability of the rubble pile increases from the shortest retorting fluid path to the longest retorting fluid path between the retorting fluid entrance and the retorting fluid exit so that the resistance to retorting fluid flow through the rubble pile along all retorting fluid paths is approximately equal; (b) establishing the retorting fluid entrance between the rubble pile and a source of retorting fluid; (c) establishing the retorting fluid exit between the rubble pile and a destination for the retorting fluid, the exit communication with the rubble pile being spaced by at least a portion of the rubble pile from the retorting fluid entrance; (d) retorting the rubble pile to extract the carbonaceous values therefrom, the retorting step including the passage of the retorting fluid through the rubble pile along the retorting fluid paths; and (e) recovering the retorted carbonaceous values.

Lewis, U.S. Pat. No. 4,017,119 is directed to a method for preparing an oil shale deposit for in situ retorting where the deposit is comprised of alternate layers of rich and lean shale. Rich shale typically contains around 25 or more gallons of oil per ton of shale, while lean shale typically contains less than 15 gallons per ton of shale. The method includes the steps of providing a vertical access tunnel in the deposit, drilling a generally horizontal tunnel from the access tunnel into the deposit, performing sublevel caving of both rich and lean layers overlining the distal end of the tunnel to rubblize the layers, removing a sufficient amount of accessible rubblized shale in the tunnel to permit the overlying rich or lean shale to drop to tunnel floor level to form a column of shale that is different from the adjacent shale rubble, and performing additional sub-level caving and shale rubble removal to form additional columns and thereby provide alternate zones of rich and lean rubblized shale.

When oil shale is mined, brought to the surface, and retorted above ground, a large volume of spent oil shale is formed which creates a disposal problem. Often, this spent shale has relatively small particle size which makes dumping undesirable from an aestetic and environmental viewpoint.

Both before, during, and after retorting of an underground in situ oil shale retort, it may be desirable to introduce various fluids into the retort. Also, it is difficult to introduce solids or viscous liquids into the retort without multiple injection points throughout the retort. It is extremely difficult to drill a hole through a retort filled with rubblized matter.

After an underground in situ oil shale retort is burned, the volume of spent shale within the retort has diminished somewhat and commonly does not adequately support the overlaying structure. This lack of support can lead to surface subsidence.

When a series of underground in situ oil shale retorts are formed in an oil shale field, it is common to leave substantial areas of intact oil shale between these retorts in order to preserve the structural integrity of the retorts, and to control the flow of gases, water, and the like.

It is an object of this invention to provide a simple and convenient method of communication with an underground in situ oil shale retort.

It is an object of this invention to provide a simple and convenient method of introducing fluids into an underground oil shale retort.

It is further an object of this invention to provide a convenient, inexpensive method of disposing of spent shale from the surface retorting of oil shale.

It is further an object of this invention to provide a method of providing structural strength and integrity to spent in situ retorts.

It is still further an object of this invention to provide a method of more complete recovery from an oil shale deposit.

SUMMARY OF THE INVENTION

This invention relates to subterranean oil shale in situ retorting and methods for providing communications with underground retorts. The invention also relates to a method of introducing fluids into an underground retort. The formation and operation of such retorts has been discussed in the background.

Disclosed is a method for providing communication with a subterranean oil shale retort. This method can be used to provide a means of introducing fluids, such as a slurry of spent oil shale in water, into a retort, especially into a retort laterally.

The method for providing lateral communication with a subterranean oil shale retort containing a rubblized retortable mass of oil shale, said retort being substantially surrounded by a mass of unmined formation comprises drilling at least one hole through the unmined formation adjacent to the retort; and providing communication between at least one of said holes and an adjacent retort; so that said drill hole can be used to communicate fluids to said retort.

Communication with underground retorts can be useful before, during and after retorting, especially after the retort is spent. For example, fluids can be introduced into a spent retort which will form a supporting structure within said retort. In this case, a method for the recovery of shale oil and disposal of spent oil shale comprises forming a subterranean oil shale retort containing a rubblized retortable mass of oil shale, said retort being substantially surrounded by a mass of unmined formation; retorting the oil shale contained in said subterranean retort so as to recover at least a portion of the shale oil present; drilling at least one hole through the unmined formation adjacent to the retort; providing communication between at least one of said holes and an adjacent retort; and passing an aqueous slurry of spent oil shale through said drill hole into said retort; so that spent oil shale can be effectively disposed of in a manner not detrimental to the environment. In this manner, finely divided particles of spent oil shale is not allowed to blow around the countryside, contaminating both air and water. Preferably, the slurry of spent shale is capable of forming sufficiently supporting structure within the spent retort so as to permit the formation of a new subterranean oil shale retort in the area almost immediately adjacent to the spent retort. This would permit the formation of another retort adjacent to the spent retort while maintaining structural integrity of the new retort with minimum waste of the in place oil shale. Use of this process would also allow the control of water and gas permeability of subterranean in situ oil shale retorts.

One method of providing communication from the surface or from a drill hole to an underground retort, especially lateral communication, is by directional drilling. One method of directional drilling comprises drilling roughly vertically until at some point the well or shaft is diverted off at an angle from the original shaft. The shafts may be cased or uncased depending on the type of formation being drilled, but in many cases they are cased. The shaft generally extends from the surface or from a drill hole laterally into the retort. Until fairly recently a whipstock was used to deviate wells. This consisted of a tapered steel wedge which was run to the bottom of the hole and orientated so that it pushed the bit off in the desired direction. There were some drawbacks with this tool. The bit used to kick off the hole was always smaller than the required hole and drilled a pilot hole which had to be enlarged. The whipstock also had to be pulled out of the hole and reset every few feet, after the pilot hole was opened out, in order to achieve sufficient angle build up.

The more modern method of kicking off a directional well commonly uses a down-hole motor or a turbodrill and a "bent sub". The string consists of a full gauge bit, turbodrill, bent sub, non-magnetic drill collar, drill collars and drill pipe. The bent sub, or angle sub, is a short piece of drill collar on which the axis of the pin is at an angle relative to the axis of the box. The angle is generally small, ranging from $\frac{1}{2}°$ to 3°. The non-magnetic drill collar is used to provide a seat for the magnetic survey instruments which are run to survey the hole. Before kick-off the turbodrill assembly is run to the bottom of the hole and a survey is taken, the instruments being run into the drill string on a wire line or the sandline. The survey instruments consist of a plumb-bob and a compass which show the inclination and direction of the drill string at the non-magnetic collar. They both can be contained within a pressure-tight case, and when seated in the collar a time-actuated camera can photograph their readings. Upon retrieval from the hole the film is rapidly developed and their readings are obtained. The kick-off string is then orientated and the mud circulation started. The turbine drives the bit with the remainder of the string restrained from rotating to maintain the direction, while building angle. The rate of building up depends on the formation and the angle of the angle sub employed.

Drilling with the motor or turbodrill continues until an adequate angle build-up is obtained, a survey being taken at intervals. The turbodrill is then pulled out of the hole and a rotary drilling string is run to continue drilling. By using various combinations of weight and rotary speed, and by changing the position of stabilizers in the drill collar string, to increase or decrease their pendulum effect, the hole can be made to build, maintain or lose angle or to change direction. This is part of the art of directional drilling, and one or two wells in any area have to be drilled before the effects of various drilling assemblies can be forecast. The degree of control required on a directional hole varies from place to place, depending on the nature of the formation being drilled, its dip, etc., and it is a case of trial and error to discover the best assemblies to use.

The hole is surveyed frequently during angle build up, but once the course is established the interval is increased. A plot of the track of the hole is kept, showing the horizontal and vertical section, to ensure that it is staying on course.

Another method of providing communication with an underground retort comprises locating one or more drill holes sufficiently near the retort and blasting that portion of the formation which restricts communication between the drill hole and the retort. This can be done, for example, by drilling a shaft from a few inches to a few feet in diameter, in the undisturbed formation almost immediately adjacent to an underground retort. It is generally desirable to size this hole or shaft considering its end use, speed of drilling desirable, and economy. Generally a hole about 2 to about 12 inches in diameter is preferable. The drill hole is located near the retort so that explosives placed within the drill hole will be able to blast that portion of the formation which restricts communication between the drill hole and the retort. In many cases, it is desirable to locate the drill hole so that it runs alongside the underground retort for a considerable distance. Then explosives can be set at various locations to provide communication at multiple locations with the underground retort.

Generally, the drill holes are spaced about 2 to about 10 feet from the subterranean in situ retort. It is sometimes difficult to space the drill hole precisely when there is a substantial amount of overburden. When the drill hole is near the retort, the drill hole can be generally exploded directly into the retort. Where there is a larger space between drill hole and retort, it may be necessary to first blast to form a small cavity at the proper depth, and then fill the cavity with explosives to establish communication with the retort. It is preferable to stem the blasts in order to get maximum utilization of the explosives.

Several commercially available industrial or mining explosives can be used. The most logical choices are dynamite, nitroglycerine, TNT, ammonium nitrate, and liquid oxygen explosives. The preferred explosives are ammonium nitrate slurries for they are the most efficient commercial blasting agent now in use. However, ammonium nitrate like TNT is comparatively difficult to detonate and therefore it is necessary to use a blasting cap or a similar activating device to set it off. In a way, this is beneficial for it increases the safety factor and insured that an explosive will not go off prematurely. Mining Engineers' Handbook, Third Edition, Volume 1, Section 4, published by John Wiley & Sons, Inc., New York, explains in detail the chemistry of explosives, peak blast pressure, influence of loading density, history of shaped-charge phenomena, explosive factors in cavity effect, as well as charging and firing characteristics. Section 4 of this text is incorporated by reference and made a part hereof.

Surface retorting of mined oil shale can be conducted by a number of methods. Currently, a number of processes such as TOSCO and Lurgi are nearing commercial reality. In the Lurgi type retorting raw fresh shale is fed into a mixer wherein it is contacted with hot spent or partially spent shale. The combined oil shales are then fed into a zone wherein the shale oil which has been retorted from the oil shale is separated from the shale. The oil is recovered and the spent and partially spent shale is passed to a zone wherein carbon is burned off the shale. This can be done by introducing air or air and fuel to the zone to combust the carbon. A preferred method is to pass the spent and partially spent shale, and air or air and fuel upwardly through a vertical elongated zone such as a lift pipe. A portion of the spent shale is then removed from the flue gas from said zone, for example, by electrostatic precipitators, and used for slurry backfilling. Another portion of the spent shale is fed to the mixer to transfer heat to fresh oil shale.

In order for a slurry of water and spent oil shale from surface retorting to be able to form a mechanically strong and environmentally acceptable structure, the spent oil shale preferably has certain properties. The spent shale should contain less than about 0.2 weight percent carbon, still more preferably less than about 0.1 weight percent carbon, so that the spent shale can be suitably wet by water. The particle size of spent shale is of some importance and preferably the spent shale should be smaller than about 150 mesh, more preferably smaller than about 200 mesh. Variations in the particle size of the spent shale may affect the viscosity and pumpability of the slurry of water and spent oil shale from surface retorting.

Suitable spent shale for slurry backfilling can be produced by passing the shale through a zone which is maintained at about 1200° F. to about 1500° F. Heating the shale in excess of 1500° F. is economically unattractive and can lead to spent shale which does not form strong structures when slurried and solidified. It is preferred to maintain the zone at about 1300° F. It is generally more convenient and cheaper if this thermal treatment or calcining is done in the surface retorting process rather than as an extra calcining step. This can be done, for example, by operating the lift pipe of a Lurgi type process at a temperature from about 1200° F. to about 1500° F. Preferably, the lift pipe temperature is maintained at about 1300° F. Also, residence time of the shale passing through the calcining zone can be adjusted to improve calcination and form a more desirable spent shale for slurry backfilling.

Slurries of water and spent shale from surface retorting can be made over wide ranges of water concentration. Generally, slurry viscosity is lowered and handling, pumping and spreading properties improved at higher water concentrations. Because much of the water must be drained out of the slurry in order for it to set up or solidify, it is also preferred to minimize the amount of water used. It is generally preferred to use about 3 to about 6 parts of water per part of spent shale.

Other materials can be added to the slurry of water and spent shale from surface retorting in order to modify various properties of the slurry or the solidified mass formed by the slurry. For example, additives can be used to modify the slurry viscosity of the slurry or adjust the permeability to water or gas of the underground retort. Plasticizers such as clays, soaps, cement, methylethylcellulose and the like can be added. Because of low cost, about 0 to about 2 weight percent clay, such as bentonite or montorillinite, based on spent shale can be added. Also, retarders such as glue, gypsum, lignin and the like can be added to stop flash set or prevent premature solidification of the slurry.

When the slurry of water and spent shale from surface retorting is introduced into a spent subterranean in situ retort, water must not be drawn away from the slurry too rapidly if the slurry is to flow properly. It is therefore preferred to cool the in situ retort to less than about 180° F. prior to introduction of the slurry of water and spent shale. This can be done by passing air, combustion gases, or water into the retort. It is also preferable to contact the spent rubblized oil shale in the in situ retort with water prior to the introduction of the slurry of water and spent oil shale from surface retorting, so that the rubblized mass does not rapidly extract water from the slurry.

In order for slurries of water and spent shale from surface retorting to form solid, strong structures, much of the water must drain from the slurry. In extremely large subterranean in situ retorts, it may be difficult for the water to drain substantial distances through liquid or solidified slurry. Drainage can be improved by introducing materials which can form structures porous to water into the subterranean in situ retort. For example, a slurry of water and about 50 to about 150 mesh sand can be introduced into the subterranean in situ retort so as to form approximately horizontal and/or vertical drainage passes for water. While only a very narrow drainage passage is theoretically necessary, practically a thicker passage is needed in order to assure a continuous path for water. For example, a horizontal sand layer may be about 3 to 5 feet thick. Generally, sand having a somewhat uniform particle size provides improved drainage. Surfactants may be used in order to improve the handling and spreading properties of the water/sand slurry. It is preferred to provide a porous layer at least near the bottom of the retort for improved water drainage. The water collected can be combined with water formed during retorting and collected in product separators, treated in water treatment processes, or used in processing.

THE DRAWING

The drawing shows an integrated oil shale retorting operation wherein both surface and subterranean oil shale restoring is conducted.

Subterranean in situ oil shale retorts 2, 3 and 4 are located within oil shale formation 1. In situ retorts 2, 3 and 4 generally have slanted bottoms to allow for the drainage of produced shale oil through sloping tunnels 7, 9 and 32 respectively. These tunnels lead to separation zones 8, 10 and 33 respectively, where oil, gas, and water are separated. These in situ retorts are formed by well-known techniques. Generally, a limited amount, about 5 to 40%, of the area to be retorted is removed to provide porosity. The surrounding formation is then rubblized explosively to provide a mass of relatively uniformly-sized particles of oil shale. In situ retorts 2 and 3 are filled with rubblized oil shale 6 and 22 respectively. This rubblized mass oil shale is retorted by passing a hot retorting fluid through rubblized mass to release shale oil from the shale. This is commonly done by generating the gases within one or more retorts. Fuel can be injected into the top of the retort to initiate combustion. After combustion of rubblized mass has been initiated, commonly air, or air plus water, or air plus off-gases from an operating retort are passed downwardly through retort to provide a flame front with advancing hot retort gases. These gases provide for the retorting of the oil shale and the production of shale oil.

The oil shale which has been removed from underground formation to provide for porosity for in situ retorts is commonly brought to the surface. This mass of oil shale 50 can then be ground or broken up to the appropriate size and retorted in surface retorts. This oil shale can be passed through line 51 to vessel or hopper 52 which then passes the oil shale through line 53 to mixer 54. In mixer 54, fresh shale is contacted with hot spent or partially spent shale and heat is transferred to the fresh shale. The mixture of shales is then passed into vessel 55 wherein shale oil is recovered from the shale and passed out of line 56 to recovery. Spent or partially spent oil shale is then passed to the bottom of vessel 55 through line 57 for further treatment, especially the removal of carbon. Pipe 58 is an elongated lift pipe which transfers spent or partially spent shale upward while air and/or fuel is passed upwardly through the same pipe from point 59. In this lift pipe carbon on shale is oxidized and the temperature of the spent shale is raised significantly. It is preferred to operate this lift pipe at a temperature of about 1200° F. to about 1500° F. in order to produce a suitable spent shale for slurry backfilling. The lift pipe is preferably operated at about 1300° F. Spent shale passes into vessel 60 and a portion of the hot spent shale then passes down to mixer 54 wherein it is contacted with fresh shale and transfers heat thereto. Off-gases containing some spent oil shale pass from vessel 60 through line 61 to electrostatic precipitator 62 which separates finally divided spent oil shale from off-gases. The off-gases are passed out through line 63. The spent shale is then passed from electrostatic precipitator 62 through line 64 to slurry tank 65. There it is contacted with water 66 and optionally small amounts of clay 67 or other additives 68 which modify various properties of the slurry. The slurry is then passed through line 69 and can optionally be passed through pump 70, such as a mud pump, through line 71 for injection into in situ retorts. In many cases, the slurry from slurry tank 65 can be injected down-hole without need for a slurry pump.

In order to form drainage paths in in situ retorts for the passage of water finally divided sand is introduced. This sand 81 is passed through line 82 to slurry tank 83 there water 84 and optionally additives 85 are added. The slurry is passed through line 86 through optional slurry pump 87 through line 88 for injection in in situ retorts.

Communication with underground retorts can be provided a number of ways. For example, a drill hole 11 approximately 4 inches in diameter, is drilled through the solid formation almost immediately adjacent to retort 2. Intact oil shale 13 yet remains between the drill hole 11 and retort 2. Explosive charges 12 are placed in drill hole 11 and exploded to provide communication from the surface through drill hole 11 into retort 2. In a similar manner, communication can be provided to the in situ retorts by directional drilling. Drill hole 48 is drilled down through solid intact oil shale formation 1. At the appropriate depth, the drill hole is angled toward retort 2 through the use of a wedge 14 which has been placed down hole. This well-known often used method of directional drilling provides lateral access through unmined intact oil shale area 16 into retort 2. By the various techniques multiple lateral communication is formed with the retorts as communications 18, 19, 20, 21, 24, 25 and 26 to subterranean in situ retort 3 and communications 27, 28, 29 and 30 to subterranean in situ oil shale retort 4.

Either or both the slurries from lines 88 or 71 can pass through these communications into the in situ retorts. The sand slurry is intended to provide drainage paths to remove water from aqueous slurries of spent shale from surface retorting. In retort 3, an approximately vertical layer or path of sand or sand slurry has been provided 49. This approximately vertical drainage path allows the drainage of water from shale slurry placed within retort 3 down the side of the retort and across the slanted bottom and down through the normal path which product flows. It is preferred to have sand slurry or sand or porous material provided at the bottom of the retort for good drainage. In retort 4 a porous layer 34 has been placed at the bottom of the retort. On top of this porous layer, a layer of shale slurry from surface retorting has been placed 35. After some solidification of layer 35, a layer of sand slurry 36 is placed approximately horizontally across the top of the shale slurry. After allowing enough time to ensure the stability of layer 36, further layers of spent shale slurry and sand slurry can be placed successively on top of layers 35 and 36. A small tunnel 37 is shown to provide a path for water draining through sand layer 36 from in situ retort 4. This small tunnel 37 can provide a path for water to drain out to, for example, a separation zone 33 to provide for the recovery of the water. The water can be sent to water purification, combined with water from in situ retorts, or used for process water.

We claim:

1. A method for the recovery of shale oil and disposal of spent oil shale comprises:

forming a subterranean oil shale retort containing a rubblized retortable mass of oil shale, said retort being substantially surrounded by a mass of unmined formation;

retorting the oil shale contained in said subterranean retort so as to recover at least a portion of the shale oil present;

drilling at least one hole through the unmined formation adjacent to the retort;

providing communication between at least one of said holes and an adjacent retort; and passing an aqueous slurry of spent oil shale through said drill hole into said retort;

so that spent oil shale can be effectively disposed of in a manner not detrimental to the environment.

2. The method of claim 1 wherein said communication between at least one of the drill holes and an adjacent retort is provided by directional drilling.

3. The method of claim 1 wherein said communication between at least one of the drill holes and an adjacent retort is provided by locating the drill hole sufficiently near the retort and blasting that portion of the formation which restricts communication between the drill hole and the retort.

4. The method of claim 1 wherein the slurry of spent shale is capable of forming a supporting structure within said spent retort so as to prevent surface subsidence.

5. The method of claim 1 wherein the slurry of spent shale is capable of forming sufficiently supporting structure within the spent retort so as to permit the formation of a new subterranean oil shale retort in the area almost immediately adjacent to the spent retort.

* * * * *

UNITED STATES PATENT OFFICE
CERTIFICATE OF CORRECTION

Patent No. 4,120,355 Dated October 17, 1978

Inventor(s) Jay C. Knepper and Eugene L. Grossman

It is certified that error appears in the above-identified patent and that said Letters Patent are hereby corrected as shown below:

The Patent Reads:

| Col. | Line | | | |
|---|---|---|---|---|
| | | Assignee should be | | Standard Oil Company (Indiana)<br>Chicago, Ill. and<br>Gulf Oil Company<br>Pittsburgh, Pennsylvania |
| 9 | 62 | "restoring" | should read | --retorting-- |
| 10 | 47 | "finally" | should read | --finely-- |
| 10 | 60 | "finally" | should read | --finely-- |

Signed and Sealed this

*Sixth* Day of *May 1980*

[SEAL]

*Attest:*

SIDNEY A. DIAMOND

*Attesting Officer*

*Commissioner of Patents and Trademarks*